US006621480B1

(12) United States Patent
Morita

(10) Patent No.: US 6,621,480 B1
(45) Date of Patent: Sep. 16, 2003

(54) PHASE ADJUSTER, PHASE ADJUSTING METHOD AND DISPLAY DEVICE

(75) Inventor: Hideo Morita, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/145,429

(22) Filed: Sep. 1, 1998

(30) Foreign Application Priority Data

Sep. 2, 1997 (JP) ..... P 9-237202

(51) Int. Cl.[7] ..... G09G 3/36
(52) U.S. Cl. ..... 345/99; 345/213; 345/87
(58) Field of Search ..... 345/213, 99, 212, 345/214; 348/537, 587; 358/150

(56) References Cited

U.S. PATENT DOCUMENTS

| | | | | | |
|---|---|---|---|---|---|
| 4,376,268 | A | * | 3/1983 | Moriya et al. | 331/10 |
| 4,385,395 | A | * | 5/1983 | Masato | 348/537 |
| 4,617,594 | A | * | 10/1986 | Katagiri et al. | 358/150 |
| 5,396,295 | A | * | 3/1995 | Furuta | 348/537 |
| 5,459,419 | A | * | 10/1995 | Hatakenaka | 327/141 |
| 5,528,309 | A | * | 6/1996 | Nguyen | 348/587 |
| 5,594,763 | A | * | 1/1997 | Nimishakavi | 375/376 |
| 5,668,594 | A | * | 9/1997 | Cahill, III | 348/194 |
| 5,731,843 | A | * | 3/1998 | Cappels, Sr. | 348/537 |
| 6,133,900 | A | * | 10/2000 | Esaki | 345/127 |

FOREIGN PATENT DOCUMENTS

| | | | |
|---|---|---|---|
| DE | 4009456 | 9/1990 | G09G/1/02 |
| DE | 19608692 | 9/1996 | H04N/9/64 |
| EP | 0749236 | 12/1996 | H04N/5/14 |
| EP | 0791913 | 8/1997 | G09G/5/18 |

* cited by examiner

*Primary Examiner*—Steven Saras
*Assistant Examiner*—Alecia D. Nelson
(74) *Attorney, Agent, or Firm*—Jay H. Maioli

(57) ABSTRACT

A phase adjuster, a phase adjusting method and a display device for adjusting a phase of a picture image signal of a picture image displayed on a display screen based on the same number of clock pulses as that of picture elements on each horizontal line generated on each horizontal line of the display screen. The phase adjuster or the display device includes a counting circuit for counting the number of clock pulses between two predetermined picture elements of the picture image on an arbitrary horizontal line over a plurality of frames. A phase adjusting circuit is provided for adjusting a phase of a clock so as to correspond to the phase of the picture image signal based on a counted result of the counting circuit. Thus, manageability or handiness can be remarkably improved.

8 Claims, 7 Drawing Sheets

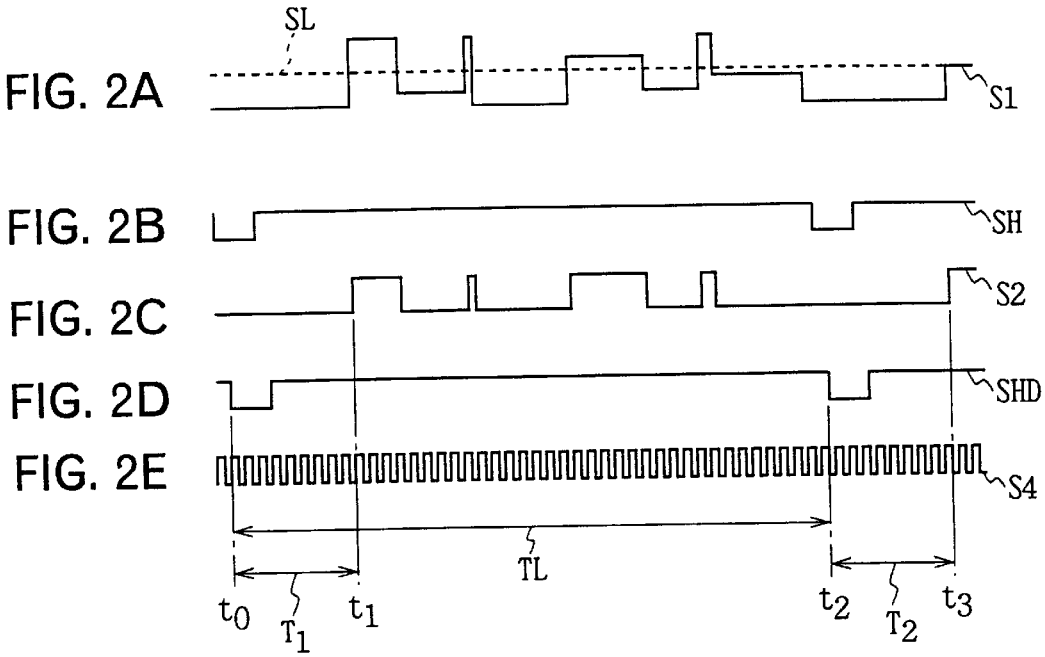
FIG. 2A
SL
S1
FIG. 2B
SH
FIG. 2C
S2
FIG. 2D
SHD
FIG. 2E
S4
TL
t0
T1
t1
t2
T2
t3
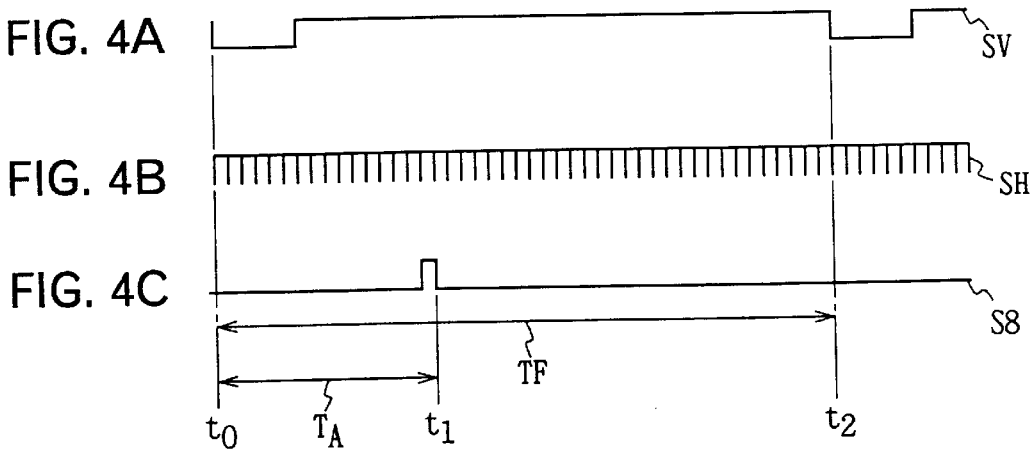
FIG. 4A
SV
FIG. 4B
SH
FIG. 4C
S8
TF
t0
TA
t1
t2

PHASE ADJUSTER, PHASE ADJUSTING METHOD AND DISPLAY DEVICE

BACKGROUND OF THE INVENTION

1. Field of the Invention

The present invention relates to a phase adjuster, a phase adjusting method and a display device which are suitably applied to a display device for displaying a video signal having a discrete picture element structure such as the video output of a computer.

2. Description of the Related Art

Conventionally, there are display devices such as an LCD (Liquid Crystal Display) or a PDP (Plasma Display Panel), etc., known as a display device to display a picture image based on a picture image signal having the discrete picture element structure outputted from a computer.

In such display devices, normally values such as sizes of H (horizontal) and V (vertical) or shifts of H and V which meet a typical signal standard of a VGA (Video Graphics Array) signal or an SVGA (Super VGA) signal or the like, have been previously stored in a storing means such as a memory. At the time of operation, the types of the inputted picture image signals are discriminated based on the polarities and frequencies of H synchronizing signals and V synchronizing signals, and the values of sizes of H and V or the values of shifts of H and V corresponding to said signal are read out. Then, the same number of clocks as that of the total number of picture elements on one H line, are generated based on said read values such as sizes of H and V, shifts of H and V. Thereby, the picture image of proper size can be displayed at a proper position based on the picture image signal by employing the above described clocks.

However, the amount of delay between a horizontal synchronizing signal and a picture image signal which are outputted from a computer, always changes depending on respective computers. Therefore, in the display device mentioned above, confirming visually the displayed picture image every time the computer is connected to the display device, a user needs to match the clock in the display device to the phase of an inputted picture element so that a picture image should be most clearly displayed.

Further, according to the conventional display device, a phase adjustment can be shifted due to the difference in temperature characteristic for the amount of delay of a picture signal system circuit and a horizontal synchronizing signal system circuit. Therefore, the phase is needed to be adjusted every time of the shift of the phase adjustment, so that the manageability or handiness of the conventional display device is undesirably problematical.

SUMMARY OF THE INVENTION

In view of the foregoing, an object of this invention is to provide a phase adjuster, a phase adjusting method and a display device by which the manageability or handiness can be extremely improved.

According to the present invention, there is provided a phase adjuster for adjusting the phase of the picture image signal of a picture image displayed on a display screen based on the same number of clocks as that of picture elements on said horizontal line generated on each horizontal line of the display screen, the phase adjuster comprising: counting means for counting the number of clocks between two predetermined picture elements of the picture image on an arbitrary horizontal line over a plurality of frames; and phase adjusting means for adjusting the phase of said clock so as to be corresponded to the phase of the picture image signal based on the counted result of said counting means. Thus, since the phase of clock can be always adjusted so as to most clearly display the picture image based on the picture image signal, the phase adjuster by which the manageability or handiness can be extremely improved can be realized.

According to the present invention, there is also provided a phase adjusting method for adjusting the phase of the picture image signal of a picture image shown on a display screen based on the same number of clocks as that of picture elements on the horizontal line generated on each horizontal line of the display screen; the phase adjusting method comprising: steps of counting the number of clocks between two predetermined picture elements of the picture image on an arbitrary horizontal line over a plurality of frames; and then adjusting the phase of said clock so as to be corresponded to the phase of the picture image signal based on the counted result. Thus, since the phase of clock can be always adjusted so as to most clearly display the picture image based on the picture image signal, the phase adjusting method by which the manageability or handiness can be extremely improved can be realized.

According to the present invention, there is further provided a display device for displaying on a display screen a picture image in accordance with a picture image signal whose phase is adjusted based on the same number of clocks as that of picture elements on the horizontal line generated on each horizontal line of the display screen, the display device comprising: counting means for counting the number of clocks between two predetermined picture elements of the picture image on an arbitrary horizontal line over a plurality of frames; and phase adjusting means for adjusting the phase of the clock so as to be corresponded to the phase of the picture image signal based on the counted result of said counting means. Thus, since the phase of clock can be always adjusted so as to most clearly display the picture image based on the picture image signal, the display device by which the manageability or handiness can be extremely improved can be realized.

As a result, even when the amount of delay between an externally inputted picture image signal and a horizontal synchronizing signal differs respectively depending on the kinds of externally inputting means, the phase of the clock can always be adjusted so as to most clearly display the picture image based on the picture image signal.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 2A to 2E are timing charts for explaining the operation of an H counter circuit;

FIGS. 4A to 4C are timing charts for explaining the operation of a V counter circuit;

DETAILED DESCRIPTION OF THE EMBODIMENT

Preferred embodiments of the present invention will be described with reference to the accompanying drawings:

(1) Constitution of Display Device According to One Embodiment

Figure 1:
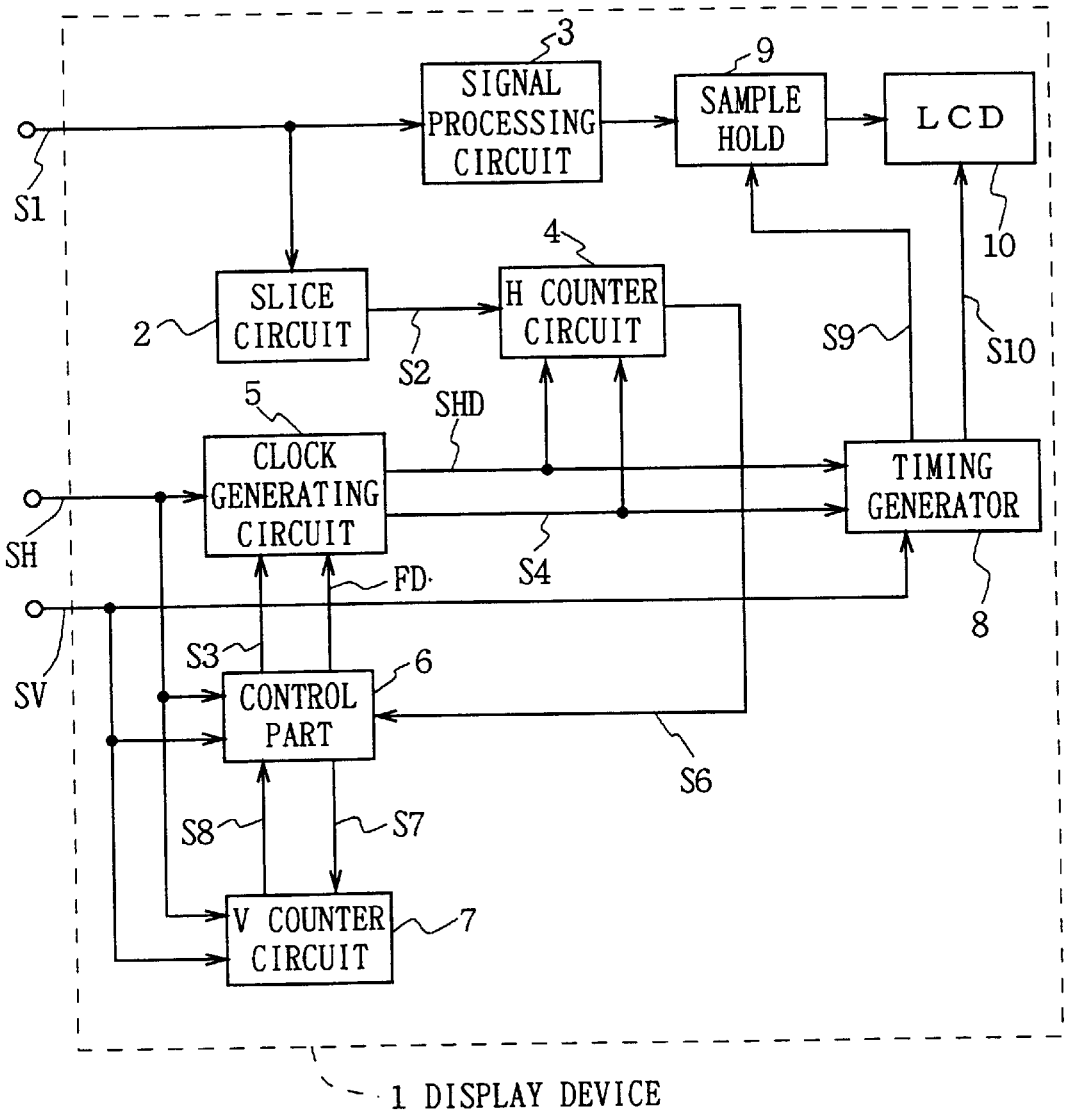
FIG. 1 is a block diagram showing the constitution of a display device according to one embodiment of the present invention.

In FIG. 1, reference numeral 1 generally designates a display device to which the present invention is applied. The display device 1 serves to input a picture image signal S1 supplied from an external computer (not shown) to a slice circuit 2 and a signal processing circuit 3. The slice circuit 2 slices the supplied picture image signal S1 (FIG. 2A) at the predetermined slice level SL which has been previously set, and then sends the picture image signal thus sliced to an H counter circuit 4 as a picture image signal S2 (FIG. 2C).

Further, a horizontal synchronizing signal SH and a vertical synchronizing signal SV are supplied to the display device 1 from the external computer, and the horizontal synchronizing signal SH thereof is sent to a clock generating circuit 5, a control part 6 and a V counter circuit 7. On the other hand, the vertical synchronizing signal SV is supplied to a timing generator 8, the control part 6 and the V counter circuit 7.

The control part 6 discriminates a signal standard (for example, a VGA signal, an SVGA signal or an XGA signal, etc.) of the picture image signal Si based on the supplied horizontal synchronizing signal SH and the vertical synchronizing signal SV. The control part 6 then sets the total number of clocks on one H line of the picture image signal Si according to the discriminated result to the number of frequency divisions (for instance, in the case of the VGA signal, the number of frequency divisions is 800), and sends said number of frequency divisions thus obtained to the clock generating circuit 5 as frequency division data FD.

Further, the control part 6 sets the amount of delay of the horizontal synchronizing signal SH inputted to the clock generating circuit 5 relative to the picture image signal S2 to a predetermined value, and then sends said amount to the clock generating circuit 5 as a delay setting signal S3, so that the phase of the clock generated by the clock generating circuit 5 can be controlled.

Figure 3:
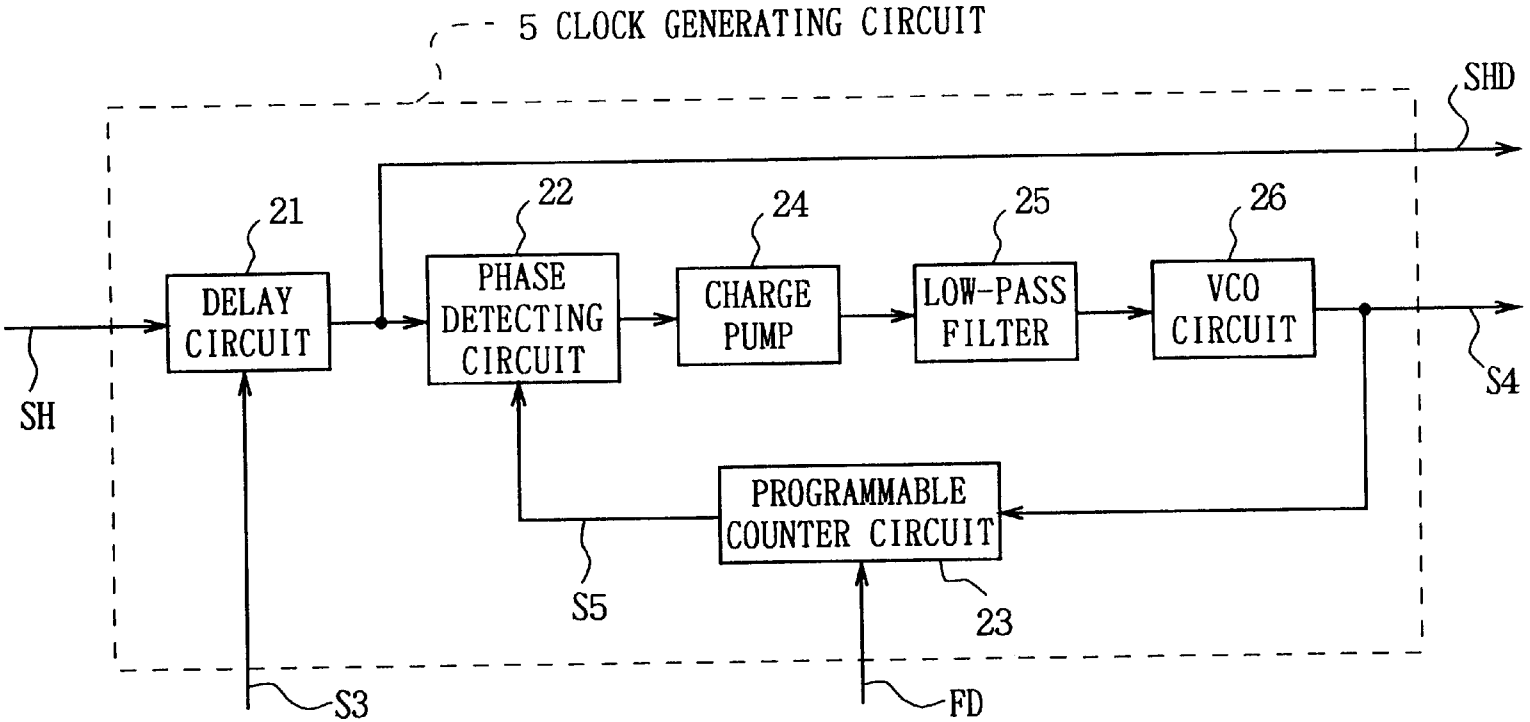
FIG. 3 is a block diagram showing the internal constitution of a clock generating circuit.

Here, the clock generating circuit 5 is constituted of a PLL (Phase Locked Loop) system as illustrated in FIG. 3. A delay circuit 21 delays the inputted horizontal synchronizing signal SH (FIG. 2B) by predetermined time in accordance with the delay setting signal S3, and then sends said delayed horizontal synchronizing signal to the H counter circuit 4 and the timing generator 8 (both are shown in FIG. 1) and a phase detecting circuit 22 as a horizontal synchronizing signal SHD (FIG. 2D).

The phase detecting circuit 22 detects the phase difference between the horizontal synchronizing signal SHD and the output of a VCO (Voltage Controlled Oscillator) circuit 26, and then sends output voltage corresponding to said phase difference to a low-pass filter 25 via a charge pump circuit 24. The low-pass filter (LPF) 25 removes the high frequency component of the supplied output voltage, smoothes the output voltage, and then transmits said smoothed output voltage to the VCO circuit 26.

The VCO circuit 26 sends a clock signal S4 (FIG. 2E) obtained by changing the frequency depending on the output voltage thus inputted to a programmable counter circuit 23. Said programmable counter circuit 23 successively multiplies the frequency of the clock signal S4 depending on the number of frequency divisions of the frequency division data FD supplied from the control part 6 (FIG. 1), and then sends said frequency thus successively multiplied to the phase detecting circuit 22 as a comparison signal S5.

At this time, since the frequency of the inputted horizontal synchronizing signal SHD is controlled so as to coincide with the frequency of the comparison signal S5 in the phase detecting circuit 22, the frequency of the clock signal S4 of the VCO circuit 26 reaches a value obtained by multiplying the frequency of the horizontal synchronizing signal SHD by the number of frequency divisions. In such a way, the VCO circuit 26 sends the clock signal S4 to the H counter circuit 4 and the timing generator 8 (both are shown in FIG. 1).

The H counter circuit 4 receives the picture image signal S2, the horizontal synchronizing signal SHD and the clock signal S4, begins to count the number of clocks of the clock signal S4 (FIG. 2E) from the fall time (line start point) $t_0$ of the delayed horizontal synchronizing signal SHD (FIG. 2D) on a predetermined line. The H counter circuit 4 stops counting at the first rise time $t_1$ of the picture image signal S2 (FIG. 2C) (hereinafter, a period from time $t_0$ to time $t_1$ is referred to as a count period $T_1$).

Subsequently, the H counter circuit 4 begins to count the number of the clocks of the clock signal S4 (FIG. 2E) from a fall time $t_2$ after the lapse of one H line period TL to the time $t_0$ in the horizontal synchronizing signal SHD (FIG. 2D) on a next line. The H counter circuit 4 stops counting at the rise time $t_3$ of the picture image signal S2 (FIG. 2C) (hereinafter, a period from time $t_2$ to time $t_3$ is referred to as a count period $T_2$).

In the same way, the H counter circuit 4 begins to count the number of the clocks of the clock signal S4 from the fall time $t_k$ of the horizontal synchronizing signal SHD at regular line intervals (at regular intervals of one H line periods TL) and stops counting at the rise time $t_{k+1}$ of the picture image signal S2. The H counter circuit 4 repeats these operations (hereinafter, a period from the time $t_k$ to the time $t_{k+1}$ is referred to as a count period $T_n$). In such a manner, the H counter circuit 4 respectively counts the number of the clocks within the count period Tn (n=1, 2, . . . ) at regular line intervals, and then sends the number of clocks thus counted to the control part 6 as a count signal S6.

When the control part 6 receives the count signal S6, it sends a line selecting signal S7 for selecting a desired line of a plurality of lines constituting the horizontal synchronizing signal SH to the V counter circuit 7.

The V counter circuit 7 counts the number of lines from the fall time (frame start point) $t_0$ of the vertical synchronizing signal SV (FIG. 4A) to a line selected from a plurality of lines forming the horizontal synchronizing signal SH (FIG. 4B) based on the line selecting signal S7, generates a fall pulse at time $t_1$ corresponding to the selected line (hereinafter, a period from time $t_0$ to time $t_1$ is referred to as a line selecting period $T_A$) and transmits the fall pulse to the control part 6 as a selection finish signal S8 (FIG. 4C). In this case, the period from the fall time $t_0$ to a next fall time $t_2$ in the vertical synchronizing signal SV is one frame period TF.

Thus, the control part 6 can always select the same line at regular intervals of successive frames. Then, the control part 6 measures the number of clocks within a count period $T_n$ of the selected line of the count signal S6 for each frame, and then decides the state of a picture image based on the picture image signal S2 in accordance with the measured result.

As a precondition for the decision at this time, since the horizontal synchronizing signal SHD (FIG. 2D) is synchronized with the clock signal S4 (FIG. 2E), as apparently shown in FIG. 2 the counting start points $t_0$, $t_2$, . . . are constantly located in a stable state. However, the picture image signal S2 (FIG. 2C) is not always synchronized with the clock signal S4. Therefore, when the H counter circuit 4 stops a counting operation, a phase at the rise time of the picture image signal S2 does not possibly correspond to the phase of the clock of the clock signal S4.

Accordingly, when the decided result is negative (when the phase of the picture image signal does not correspond to the phase of the clock signal), the control part 6 resets the amount of delay between the horizontal synchronizing signal SH and the picture image signal S2 to a predetermined value, sends the obtained delay setting signal S3 to the clock generating circuit 5 and adjusts the phase of the clock signal S4 generated by the clock generating circuit 5 so as to be corresponded to the phase of the picture image signal S2.

After that, the clock generating circuit 5 sends the horizontal synchronizing signal SHD delayed by a predetermined time based on the delay setting signal S3 and the clock signal S4 whose phase is adjusted, to the timing generator 8. When the timing generator 8 receives the horizontal synchronizing signal SHD, the clock signal S4 and the vertical synchronizing signal SV, the timing generator 8 transmits timing signals S9 and S10 whose phases are synchronized with those of these signals respectively to a sample hold circuit 9 and an LCD 10.

Thus, while the picture image signal S1 inputted via the signal processing circuit 3 is brought into a state in which its phase is corresponded to that of the timing signal S9, the picture image signal is sampled in the sample hold circuit 9. Then, while the picture image signal is synchronized with the timing signal S10 in the next LCD 10, it is displayed on a display screen.

(2) Phase Adjusting Procedure According to One Embodiment

Figure 5:
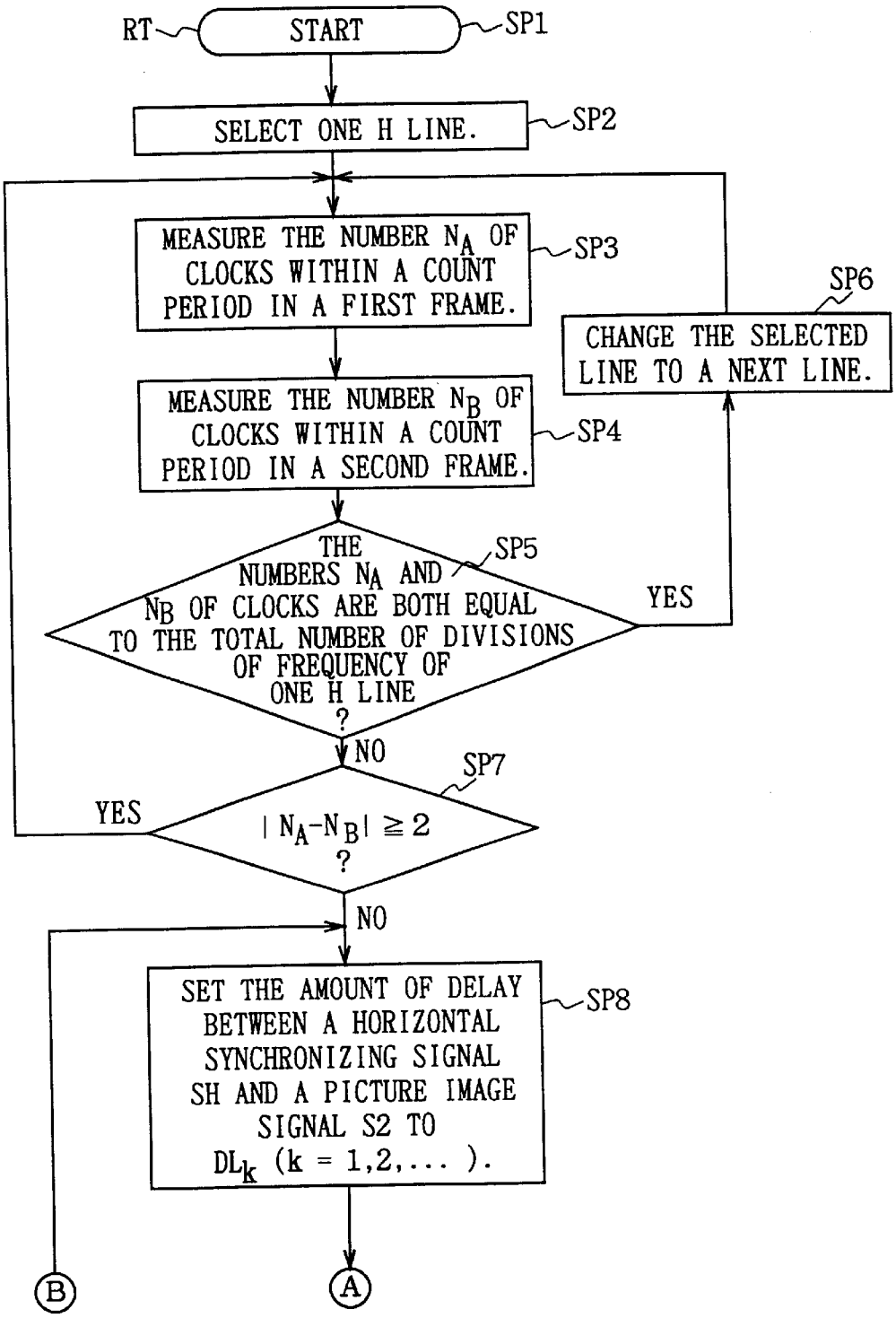
FIG. 5 is a flowchart used for explaining a phase adjusting procedure.

The phase adjusting operation described above is carried out under the control of the control part 6 based on the respective counted results of the H counter circuit 4 and the V counter circuit 7. In practice, when the count signal S6 is supplied to the control part 6 from the H counter circuit 4, the control part 6 starts the phase adjusting procedure in a step SP1 in accordance with the phase adjusting procedure RT shown in FIGS. 5 and 6. In the next step SP2, the control part 6 controls the V counter circuit 7 to select a desired line (for instance, the V counter circuit selects a 10th line from the frame start point).

Then, the control part 6 advances to a step SP3 to measure the number $N_A$ of the clocks within the count period of the line selected in a first frame, and then moves to a step SP4 to also measure the number $N_B$ of the clocks within the count period of the line selected in a second frame subsequent to the first frame.

Next, in a step SP5, the control part 6 decides whether the number $N_A$ of the clocks and the number $N_B$ of the clocks are both the same as the total number of divisions of frequency of one H line or not. When an affirmative result is obtained, this indicates that the signal level of the picture image signal S2 is not higher than a slice level SL, or the color of the picture image signal is black or gray. At this time, the control part 6 proceeds to a step SP 6 to change the selected line (for example, change the 10th line to an 11th line), and then returns to the step SP3.

On the other hand, when a negative result is obtained in the step SP5, the control part 6 advances to a step SP7 to decide whether the difference between the number $N_A$ of the clocks and the number $N_B$ of the clocks is two or more. When an affirmative result is obtained in said step SP7, this indicates that a picture image based on the picture image signal S2 is displayed as an effective picture plane on the LCD 10, and as an animated or moving picture. At this time, the control part 6 returns to the step SP3 again and repeats the above described processings until the picture image becomes a static picture image from the moving picture image.

On the contrary, when a negative result is obtained in the step SP7, this means that the difference between the number $N_A$ of the clocks and the number $N_B$ of the clocks is 0 or 1. At this time, the control part 6 decides the selected line as an object in which the phase is to be adjusted. Then, in a step SP8, the control part 6 sets the amount of delay between the horizontal synchronizing signal SH and the picture image signal S2 to $DL_1$, and then adjusts the phase of the clock signal S4 generated by the clock generating circuit 5 based on the amount of delay $DL_1$ so as to be corresponded to the phase of the picture image signal S2.

Figure 6:
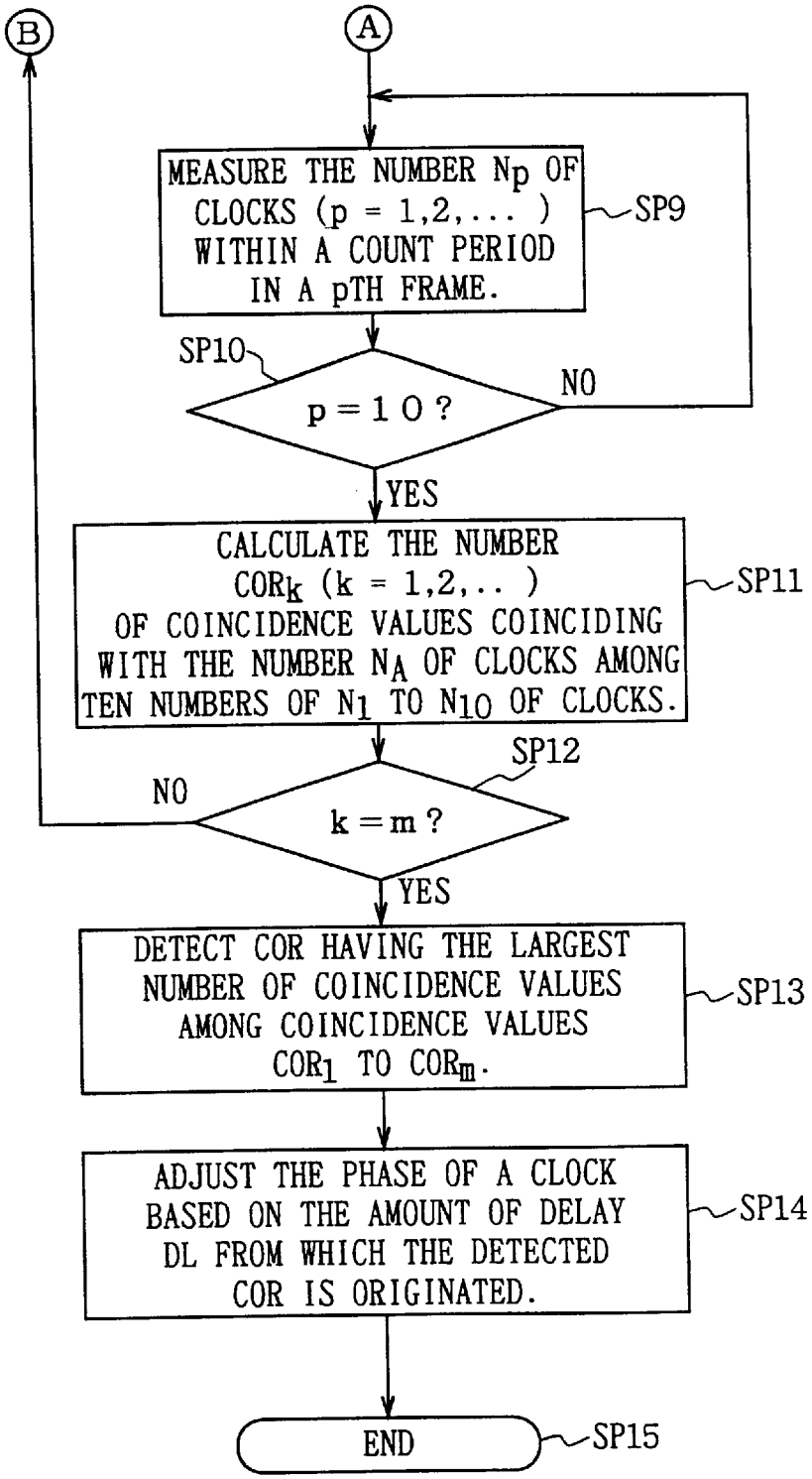
FIG. 6 is a flowchart used for explaining a phase adjusting procedure.

After that, the control part 6 advances to a step SP9 shown in FIG. 6, and continues to measure the number $N_1$, $N_2$, . . . of the clocks within the count period of each of frames sequentially from the first frame on the line to the same as the line selected in the step SP7. Then, the control part 6 proceeds to a step SP10 and repeats again the processings same as those of the step SP9 until it finishes measuring the number $N_{10}$ of the clocks within the count period in the 10th frame.

Subsequently, in a step SP11, the control part 6 calculates the number $COR_1$ which coincides with the above mentioned number $N_A$ (or $N_B$) of the clocks among ten numbers $N_1$ to $N_{10}$ of the clocks (hereinafter, said number is referred to as a coincidence value), and then advances to a step SP12.

In the step SP12, the control part 6 returns again to the step SP8 and sequentially sets a plurality of amount of delay $DL_2$, $DL_3$, . . . DL, which are different from the amount of delay $DL_1$ within a range where the phase of the clock signal S4 generated by the clock generating circuit 5 can be adjusted in order to correspond to the phase of the picture image signal S2. Then, the control part 6 repeats the processings same as the above stated steps SP9, SP10 and SP11 respectively for each of the amount of delay $DL_2$, $DL_3$, . . . , $DL_m$.

In a step SP13, the control part 6 then detects COR which has the largest number of coincidence values among the coincidence values $COR_1$ to $COR_m$. The control part 6 then moves to a step SP14, and adjusts the phase of the clock signal S4 generated by the clock generating circuit 5 so as to be corresponded to the phase of the picture image signal S2 based on the amount of delay DL from which said detected COR is originated. Thereafter, the control part 6 proceeds to a step SP15 to complete the phase adjusting procedure RT.

(3) Operation and Effects According to One Embodiment

According to the display device 1 having the above described construction, when the picture image based on the picture image signal S1 supplied from an external computer is displayed on the display screen of the LCD 10, one desired H line is initially selected on the display screen of the LCD 10. Then, the number of the picture elements between the left end of the display screen of the LCD 10 and the left end of the picture image based on the picture image signal S1 is measured in two successive frames on the line as the number of clocks within a count period.

Then, when the numbers $N_A$ and $N_B$ of the clocks within the count periods which are obtained from the respective frames are both equal to the total number of divisions of frequency of one H line, it is decided that: the selected line is not displayed as an effective picture plane on the LCD 10; or that the color of the line is black or gray or the like, and said line is changed to a different line.

On the other hand, when the difference between the number $N_A$ of the clocks and the number $N_B$ of the clocks is two or more, the control part 6 displays the selected line as an effective picture plane on the LCD 10. However, since it is decided that said line is displayed as an animated or moving picture, the above mentioned measuring processings are repeated until the moving picture becomes a static picture.

Further, when the difference between the number $N_A$ of the clocks and the number $N_B$ of the clocks is 0 or 1, the control part 6 decides that the selected line is displayed as an effective picture plane and a static picture on the LCD 10, and decides said selected line as a line in which the phase is to be adjusted.

After that, the control part 6 sets a plurality of amount of delay between the horizontal synchronizing signal SH and the picture image signal S1 which are outputted from the computer, and adjusts the phase of the clock in the LCD 10 so as to be corresponded respectively to the phase of the picture image signal S1 based on the amount of delay.

Then, while the control part 6 adjusts the phase of the clock depending on each amount of delay, it measures the number of the clocks within the count periods sequentially at regular intervals of the successive frames on the line the same as that determined previously, and then calculates how many coincidence values which coincide with the number $N_A$ (or $N_B$) of the clocks are included among the ten numbers of the clocks thus measured. The control part 6 detects the number of the clocks having the largest number of coincidence values, and adjusts the phase of the clock in the LCD 10 so as to be corresponded to the phase of the picture image signal S1 based on the amount of delay from which the largest number of coincidence values is originated.

As a result, according to the display device 1, even when the amount of delay between the horizontal synchronizing signal SH and the picture image signal S1 which are externally inputted differs depending on the kinds of the computers, the phase of the clock in the LCD 10 is in the state where said phase always adjusted so that the picture image based on the picture image signal S1 can be most clearly seen. Therefore, the picture image based on the picture image signal S1 can be represented with a proper size on the suitable position of the display screen of the LCD 10.

Further, even when the phase adjustment of the clock is shifted in the LCD 10, which is resulted from the difference in temperature characteristic for the amount of delay between the picture signal system circuit and the horizontal synchronizing signal system circuit, such a troublesome work as to adjust the phase by a user can be avoided.

According to the above stated constitution, when the picture image based on the picture image signal S1 supplied from the external computer is displayed on the screen of the LCD 10, on one selected and desired H line, the number of the picture elements between the left end of the display screen of the LCD 10 and the left end of the picture image based on the picture image signal S1 is counted for a plurality of succeeding frames as the number of clocks within the count periods, the phase of clock in the LCD 10 is adjusted so as to be corresponded to the phase of the picture image signal S1 based on the counted result. Thus, even in case that the amount of delay between the horizontal synchronizing signal SH and the picture image signal S1 which are inputted externally changes respectively depending on the kinds of the computers, the phase of the clock in the LCD 10 can be constantly adjusted so that the picture image based on the picture image signal S1 can be most distinctly represented. Thus, the display device 1 whose manageability or handiness can be remarkably improved can be realized.

(4) Other Embodiments

Figure 7:
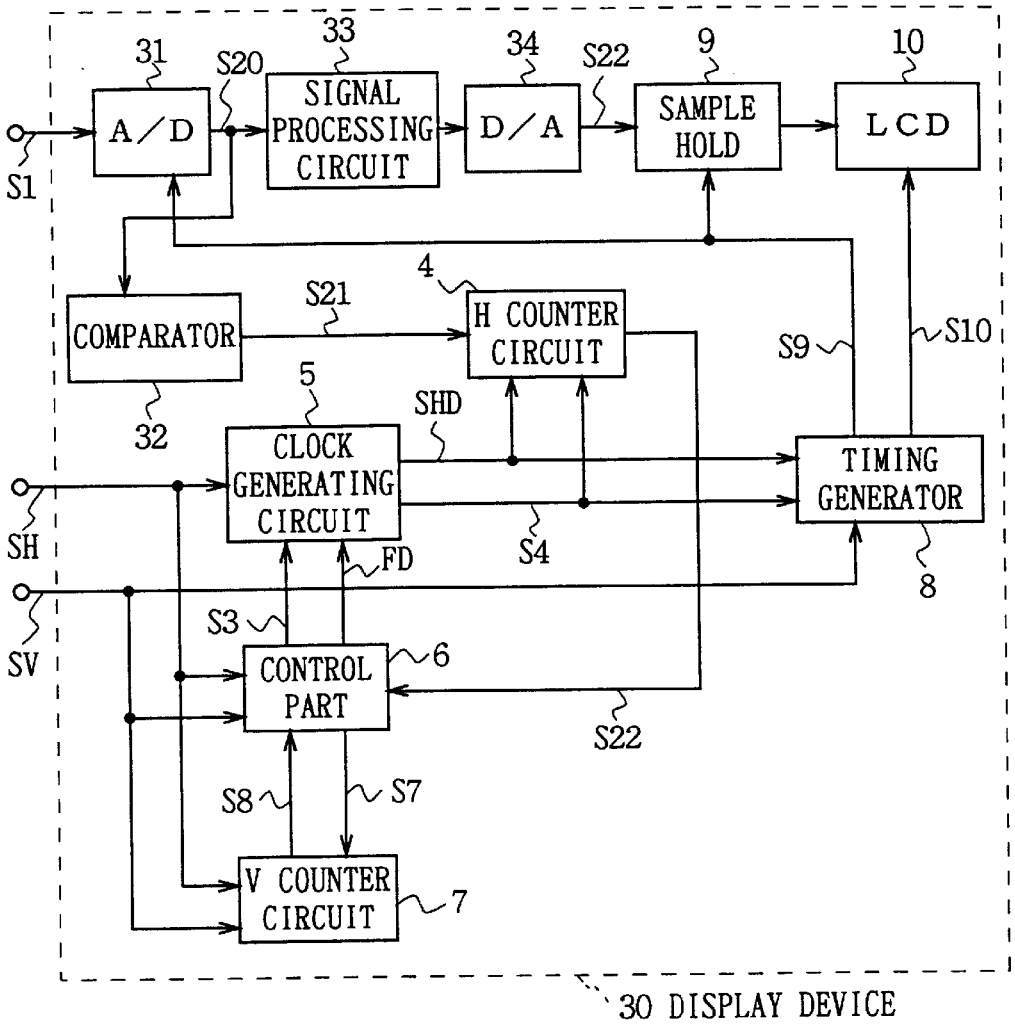
FIG. 7 is a block diagram showing the constitution of a display device according to another embodiment of the present invention.

In the above described embodiment, although a description is given to a case where the picture image signal S1 outputted from the computer is subjected to an analog signal processing, the present invention is not limited thereto and the picture image signal S1 can be subjected to a digital signal processing. In this case, referring to FIG. 7 in which parts corresponding to those in FIG. 1 are designated by the same reference numerals, a picture image signal S1 is subjected to a digital conversion with an A/D (analog/digital) converting circuit 31 in a display device 30, and then said digitally converted signal is sent to a comparator 32 and a signal processing circuit 33 as a picture image signal S20.

The comparator 32 binarizes the supplied picture image signal S20 by referring to the predetermined threshold level which has been previously set, and then, supplies said binarized picture image signal to an H counter 4 as a picture image signal S21. For example, in case of 8 bit data, since the picture image signal S20 has values of 0 to 255, a threshold value is set to, for instance, 180, in the comparator 32, so that the picture image signal S21 obtained by deleting the values smaller than 180 in the picture image signal S20 is outputted. Thus, even in the case of the digital signal, the picture image signal can be sliced at a predetermined level as well as the analog signal (FIG. 2A) in the above described embodiment of the present invention.

In the meantime, the signal processing circuit 33 gives processings such as white balance, contrast, brightness, gamma correction and the conversion of the number of picture elements (scanning conversion) to the digitized picture image signal S20. Then, the signal processing circuit 33 transmits a picture image signal S22 obtained after an analog conversion with a D/A (digital/analog) converting circuit 34 to a sample hold circuit 9.

A clock outputted from a clock generating circuit 5 is supplied to the A/D converting circuit 31 via a timing generator 8. When the phase of the clock outputted from the clock generating circuit 5 does not correspond to the phase of the picture image signal S1, the picture image signal S20 obtained after the digital conversion can not be possibly stabilized on the edge of the picture image based on the picture image signal S1. At this time, a jitter for one clock is generated on the edge of the picture image based on the picture image signal S20. As a result, a jitter for one clock is also generated on the picture image signal S21 sliced by the comparator 32.

Accordingly, as well as to the above described phase adjusting procedure RT (FIGS. 5 and 6), a control part 6 counts the number of clocks within count periods at regular frame intervals on one selected H line of the count signal S22 outputted from the H counter circuit 4. According to the counted result, the deviation of the number of clocks between the respective frames is 1. Therefore, the control part 6 controls the deviation of the number of clocks between the successive frames to become 0, so that it can adjust the phase of the clock in the LCD 10 so as to be corresponded to the phase of the picture image signal S1 as well as the case of an analog signal processing.

Figure 8:
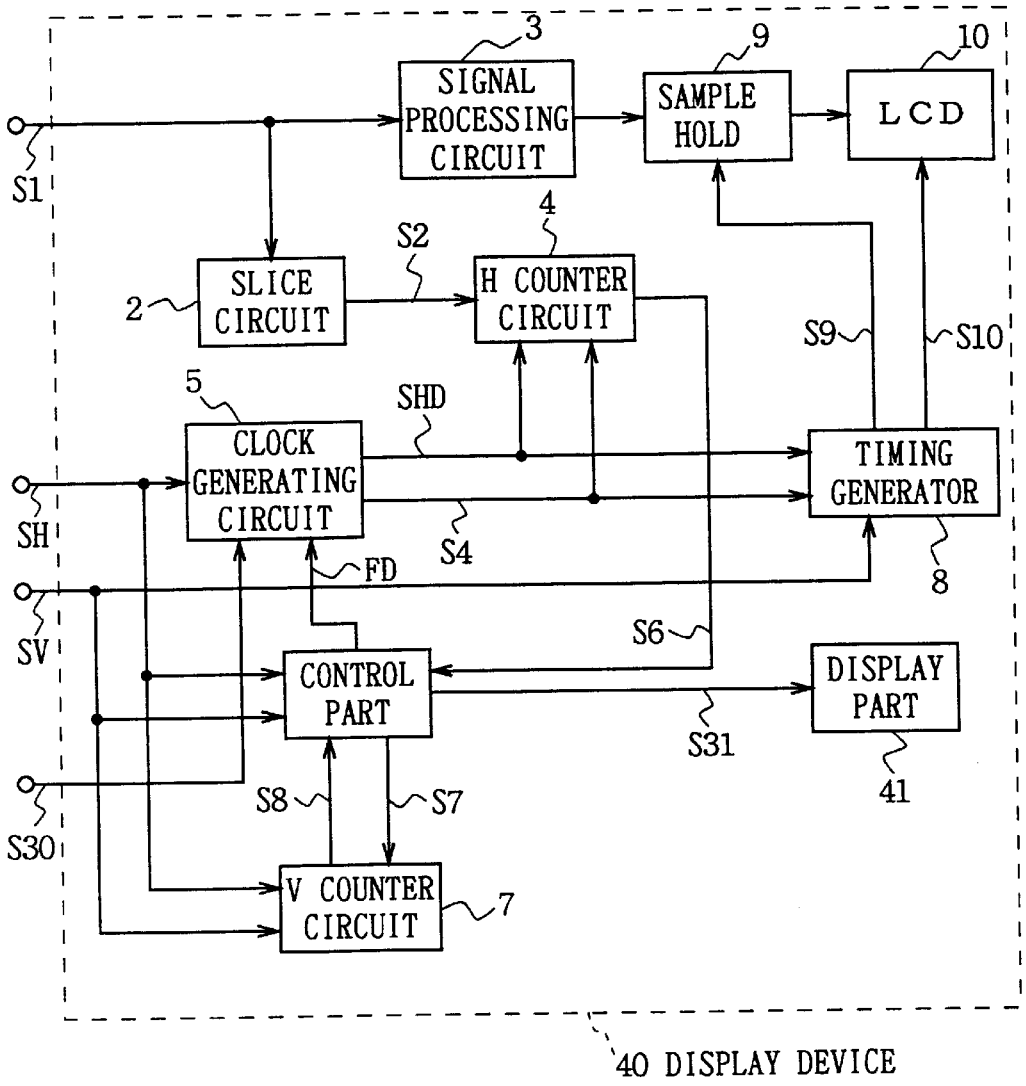
FIG. 8 is a block diagram showing the constitution of a display device according to other embodiment of the present invention.

Further, in the above described embodiment, although a description given to a case where the phase of the picture image signal S1 is automatically adjusted, the present invention is not limited thereto, and the phase adjustment can be processed under the control of a user. In this case, in a display device 40 as shown in FIG. 8 in which parts corresponding to those in FIG. 1 are designated by the same reference numerals, the user sets the amount of delay of a horizontal synchronizing signal SH inputted to a clock generating circuit 5 relative to a picture image signal S2 by using an externally set inputting means (not shown), and then, supplies said amount of delay thus set to the clock generating circuit 5 in the display device 40 as a delay setting signal S30.

Thus, a control part 6 counts, based on a count signal S6 obtained from an H counter circuit 4, the number of clocks within count periods on a selected line of said count signal S6 at regular frame intervals. Then, based on the counted result, the control part 6 transmits information indicating whether the phase of the clock generated by the clock generating circuit 5 corresponds to the phase of the picture image signal S1 or not to a display part (display means) 41 provided in the display device 40 as a phase state signal S31, and displays a picture image on a screen.

Consequently, confirming visually a state indicating whether the phase of the clock generated by the clock generating circuit 5 corresponds to the phase of the picture image signal S1, a user can perform a phase adjustment. In such a way, the phase can be adjusted by a method of visually confirming the state indicating that the phase of the clock corresponds to the phase of the picture image signal or not, as described above, more extremely easily than a method of directly observing the picture image based on the picture image signal S1.

Further, in the above described embodiment, a description is directed to counting means for counting the number of clocks between two predetermined picture elements on the arbitrary horizontal line of the picture image based on the picture image signal S1 over a plurality of frames, said counting means comprises the control part 6, the H counter circuit 4, the clock generating circuit 5 and the V counter circuit 7. However, the present invention is not limited thereto, but various other kinds of constitutions can be applied thereto.

Furthermore, in the above described embodiment, a description is given of the phase adjusting means for adjusting the phase of the clock so as to be corresponded to the phase of the picture image signal based on the counted result of the counting means (the control part 6, the H counter circuit 4, the clock generating circuit 5 and the V counter circuit 7), said phase adjusting means comprises the control part 6. However, the present invention is not limited thereto, but a variety of other constitutions can be applied thereto.

While there has been described in connection with the preferred embodiments of the invention, it will be obvious to those skilled in the art that various changes and modifications can be aimed, therefore, to cover in the appended claims all such changes and modifications as fall within the true spirit and scope of the invention.

What is claimed is:

1. A phase adjuster for adjusting a phase of a picture image signal of a picture image displayed on a display screen based on a number of clock pulses in a clock signal equal to a number of picture elements generated on each of a plurality of horizontal lines of said display screen, said phase adjuster comprising:

counting means for counting a number of said clock pulses, corresponding to a delay time, during a count period between a first predetermined picture element and a second predetermined picture element on an arbitrary one of said plurality of horizontal lines of said picture image, said counting being performed over a plurality of frames; and phase adjusting means for adjusting a phase of said clock signal to correspond to said phase of said picture image signal based on a counted result from said counting means.

2. The phase adjuster as set forth in claim 1, wherein said counting means decides whether said picture image on one of said plurality of horizontal lines is an effective static picture image based on said counted result, and when a decided result of said counting means is negative said counting means selects a different horizontal line from said plurality of horizontal lines for use in adjusting said phase of said picture image signal.

3. The phase adjuster as set forth in claim 1, further comprising:

displaying means for displaying said counted result of said counting means.

4. A phase adjusting method for adjusting a phase of a picture image signal of a picture image displayed on a display screen based on a number of clock pulses in a clock signal equal to a number of picture elements generated on each of a plurality of horizontal lines of said display screen, said phase adjusting method comprising the steps of:

counting a number of said clock pulses, corresponding to a delay time, during a count period between a first predetermined picture element and a second predetermined picture element on an arbitrary one of said plurality of horizontal lines of said picture image, said counting being performed over a plurality of frames; and adjusting a phase of said clock signal to correspond to said phase of said picture image signal based on a counted result from said counting step.

5. The phase adjusting method as set forth in claim 4, comprising the further steps of:

determining whether said picture image on one of said plurality of horizontal lines is an effective static picture image based on said counted result; and when a decided result based on said counted result is negative, selecting a different one of said plurality of horizontal lines for use in adjusting said phase of said picture image signal.

6. A display device for displaying on a display screen a picture image in accordance with a picture image signal whose phase is adjusted based on a number of clock pulses in a clock signal equal to a number of picture elements generated on each of a plurality of horizontal lines of said display screen, said display device comprising:

counting means for counting a number of said clock pulses, corresponding to a delay time, during a count period between a first predetermined picture element and a second predetermined picture element on an arbitrary one of said plurality of horizontal lines of said picture image, said counting being performed over a plurality of frames; and phase adjusting means for adjusting a phase of said clock signal to correspond to said phase of said picture image signal based on a counted result from said counting means.

7. The display device as set forth in claim 6, wherein said counting means decides whether said picture image on one of said plurality of horizontal lines is an effective static picture image based on said counted result, and when a decided result of said counting means is negative, said counting means selects a different one of said plurality of horizontal lines for use in adjusting said phase of said picture image signal.

8. The display device as set forth in claim 6, further comprising:

displaying means for displaying said counted result of said counting means.

* * * * *